US005265426A

United States Patent [19]

Gistau-Baguer

[11] Patent Number: 5,265,426

[45] Date of Patent: Nov. 30, 1993

[54] COMPRESSION CIRCUIT FOR A LOW PRESSURE LOW TEMPERATURE GASEOUS FLUID

[75] Inventor: Guy Gistau-Baguer, Biviers, France

[73] Assignee: L'Air Liquide, Societe Anonyme pour L'Etude et L'Exploitation des Procedes Georges Claude, Paris, France

[21] Appl. No.: 918,020

[22] Filed: Jul. 24, 1992

[30] Foreign Application Priority Data

Jul. 26, 1991 [FR] France ..... 91 09482

[51] Int. Cl.[5] ..... F25J 1/00

[52] U.S. Cl. ..... 62/9; 62/467

[58] Field of Search ..... 62/9, 467, 510

[56] References Cited

U.S. PATENT DOCUMENTS

| | | | |
|---|---|---|---|
| 3,092,976 | 6/1963 | Hashemi-Tafreshi | 62/117 |
| 3,645,106 | 2/1972 | Gaumer, Jr. et al. | 62/9 |
| 4,267,701 | 5/1981 | Toscano | 62/9 |
| 4,444,019 | 4/1984 | Arkharov et al. | 62/467 |
| 4,638,639 | 1/1987 | Marshall et al. | 62/9 |
| 4,910,972 | 3/1990 | Jaster | 62/335 |

*Primary Examiner*—Ronald O. Capossela

[57] ABSTRACT

The compression circuit for a gaseous fluid, typically helium, which is present in a first container at a pressure lower than 20 hPa and a temperature lower than 4.2K is compressed by means of a plurality of compressors mounted in series, at least one heat exchanger being disposed in the chain of compressors and cooled through said fluid at a temperature higher than the temperature of the fluid in the first container, said fluid originating from a second fluid container which is associated with a refrigerating cycle. Application for example to devices for cooling supraconductor elements.

12 Claims, 3 Drawing Sheets

COMPRESSION CIRCUIT FOR A LOW PRESSURE LOW TEMPERATURE GASEOUS FLUID

BACKGROUND OF INVENTION (a) Field of the Invention

The present invention concerns a compression circuit for a low pressure low temperature gaseous fluid, for example, helium, from a first container containing said fluid in gaseous and liquid phases at a first pressure and first temperature, the circuit comprising, in a line connecting the first container to a heating device, at least two compressors mounted in series, the first container being fed by a second container having said fluid in gaseous and liquid phases at a second pressure and a second temperature higher than the first pressure and temperature, respectively.

(b) Description of Prior Art

In some applications, for example for refrigerating supraconductor elements in accelerators of particles, there is a need to be able to rely on a fluid at very low temperatures, lower than 4.2K, the pressure of the fluid, under these conditions, being also very reduced, to lower than 20 hPa. In order to reintroduce the gaseous fluid at this very low pressure in the cycle of refrigeration, at least two, in practice a plurality of cryogenic compressors mounted in series, are used according to an arrangement which is difficult to master by reason of the instability which may appear along the line.

SUMMARY OF INVENTION

It is an object of the present invention to propose a compression circuit of the type mentioned above, which presents an increased stability of operation, enabling to optimize the compression stages and, for example, to reduce their size and power, and to increase the global efficiency of the device incorporating the circuit.

For this purpose, according to a characteristic of the invention, the circuit comprises, between two compressors, at least one first exchanger which is cooled by means of a fluid which originates from the second container.

According to an aspect of the invention, the first exchanger is cooled by means of the liquid phase which originates from the second container, by utilizing the fluid in liquid form which boils at atmospheric pressure. According to another aspect of the invention, the first exchanger is cooled by means of the gaseous phase which originates from the second container by utilizing the liquid fluid which boils at reduced pressure.

BRIEF DESCRIPTION OF DRAWINGS

Other characteristics and advantages of the present invention will appear from the description which follows of embodiments, given by way of illustration, but without limitation, with reference to the annexed drawings, in which.

DESCRIPTION OF PREFERRED EMBODIMENTS

Figure 1:
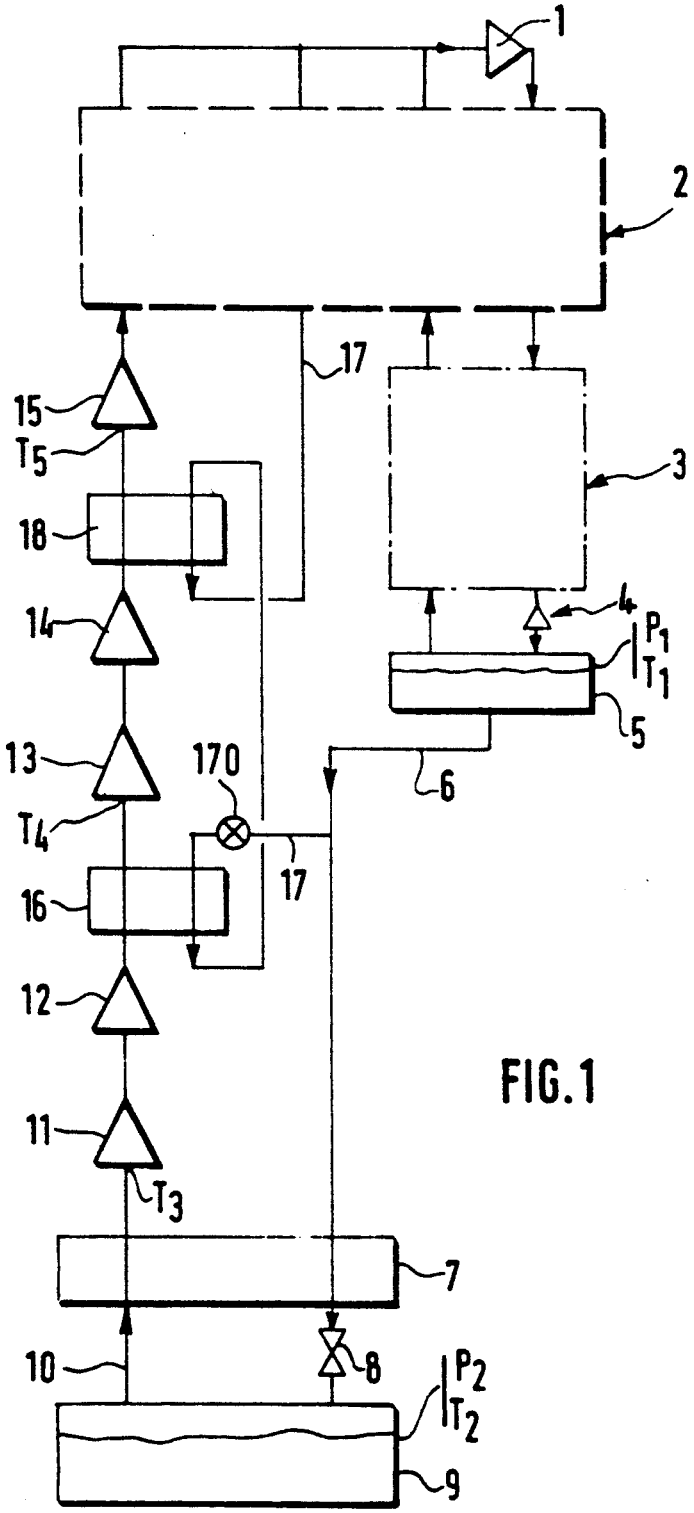
FIG. 1 is a schematic view of a refrigerating device incorporating a first embodiment of the compression circuit according to the invention.

In the description which follows and in the drawings, the same and analogous elements have the same reference numerals, possibly indexed.

FIG. 1 shows a cycle for refrigerating helium comprising a cycle compressor 1, a pre-cooling stage 2, a cooling stage 3 and a final expansion device 4 providing liquid helium in a container 5 at a pressure of $P_1$ of the order of $1.2\times10^5$ Pa and a temperature $T_1$ of about 4.4K. Such a device is described in French Application FR 90.13280, in the name of the Applicant, whose content is understood to be incorporated herein by reference. The liquid in container 5 is extracted via line 6 to be cooled in an exchanger 7 and expanded in an expanding device 8, consisting of an isenthalpic valve, a turbine or a piston type expander, so as to provide in a supercold container 9, fluid and gaseous helium at a temperature $T_2$ of the order of 1.75K and a pressure $P_2$ of the order of 13 hPa. The gaseous atmosphere in the container 9 should be recompressed and reheated to be recycled towards the cycle compressor 1.

For this purpose, a compression line 10 extends from the container 9 to the pre-cooling stage 2 by first being passed in counter-current through the exchanger 7 and by passing through a series of cryogenic compressors 11 to 15, here five. Each compressor has a compression rate of the order of 3 so as to bring the gas pressure in line 10 upstream of the pre-cooling stage 2, to a value slightly higher than atmospheric pressure, of the order of $1.2\times10^5$ Pa. The temperature $T_3$ of the gas which exits from exchanger 7 and at the inlet of the first stage of compressor 11 is of the order of 3.5K and it is understood that any variations in the pressure conditions and mainly of the temperature at the inlet of the compression chain may cause instabilities of operation in the downstream stages, in as much as each compression causes a slight increase of the gas temperature. The compression power, therefore the size of the compressor, being proportional to the suction temperature of the pressure and, for a given mass load, to the volume flow, varying inversely to the temperature, a cooling of the gas between two compression stages presents substantial advantages on the optimization of these compression stages and enables to restabilize at least one of the inlet temperatures of a compression inter-stage, which largely facilitates the operation of the chain of compression.

For this purpose, according to the invention, a first exchanger 16 is disposed between the second and third compressors 12 and 13, this exchanger being cooled by means of a liquid which has been taken, through a channel 17, advantageously provided with a flow control device 170, from line 6, i.e. at a temperature $T_1$ of 4.4K. In the illustrated embodiment, duct 17 is extended for the purpose of cooling, by means of the vaporized gas which exits from the exchanger 16 at a temperature of the order of 10K, a second exchanger 18 disposed between the fourth and fifth compressors 14, 15, duct 17 being extended to recycle the gas which has been taken, towards the compressor of cycle 1 through the pre-cooling stage 2. In this manner, the gas temperature in line 10 at the inlet of the third compressor 13, is brought back and stabilized at a temperature $T_4$ of the order of 5 to 6K and the temperature of the gas at the inlet of the fifth compressor 15 is brought back and stabilized at a temperature $T_5$ of the order of 12K.

Figure 2:
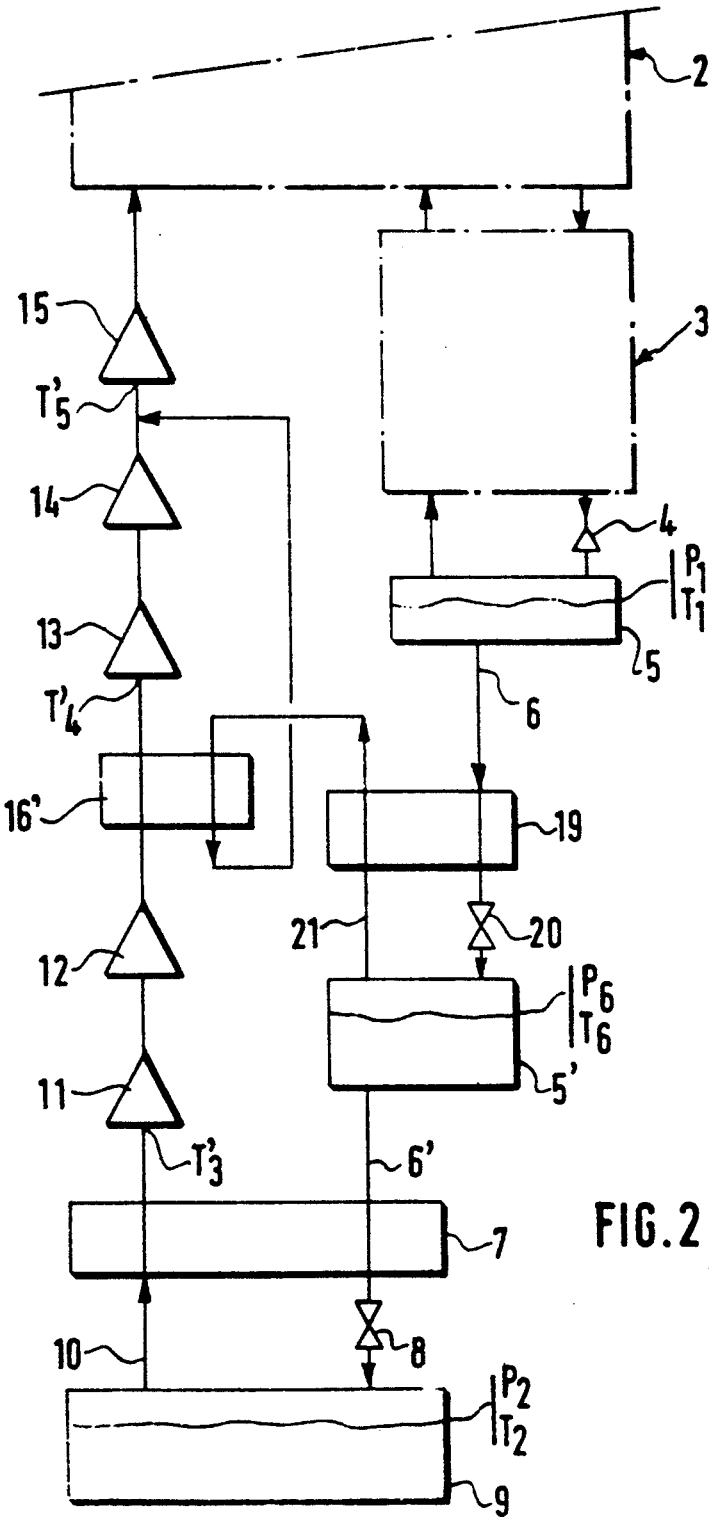
FIG. 2 is a view analogous to the preceding view illustrating a second embodiment of the invention.

In the embodiment of FIG. 2, the inter-stage cooling of the compression chain is ensured by means of gaseous helium which originates from an additional container 5' where helium boils at a reduced pressure. In this embodiment, channel 6 for liquid helium withdrawn from container 5 passes through an exchanger 19 to give, via an expansion device 20, liquid and gaseous helium in container 5' at a pressure $P_6$ of about $0.5\times10^5$ Pa and a temperature of about 3.5K. The liquid helium from container 5' is withdrawn through channel 6' to be led, via exchanger 7 and expansion device 8, as in the previous embodiment, towards container 9 at pressure and temperature $P_2$ and $T_2$.

In this embodiment, the temperature of liquid helium in duct 6' at the inlet of the hot end of the exchanger 7 being 3.5K instead of 4.4K as in the previous embodiment, the temperature of the gas in line 10, at the outlet of this exchanger 7 and at the inlet of the first compression stage 11 is here at a temperature $T'_3$ of the order of 2.5K, which enables to gain 1K upstream of the compression chain and therefore to still gain over the mechanical and thermodynamic performances of the compression chain. As in the previous embodiment, an exchanger 16' is disposed between the second (12) and third (13) stages of compression, this exchanger 16' being here cooled by means of a gas which is taken from container 5' through a duct 21 which first passes through the exchanger 19, then exchanger 16', so that the temperature $T'_4$ of the gas at the inlet of the third compression stage 13 is brought back and stabilized at about 5K, duct 21 extending to reinject the reheated gas in exchanger 16' upstream of the downstream compressor 15 so as to bring back and stabilize the inlet temperature of the last stage 15 at a value $T'_5$ of the order of 7K.

Figure 3:
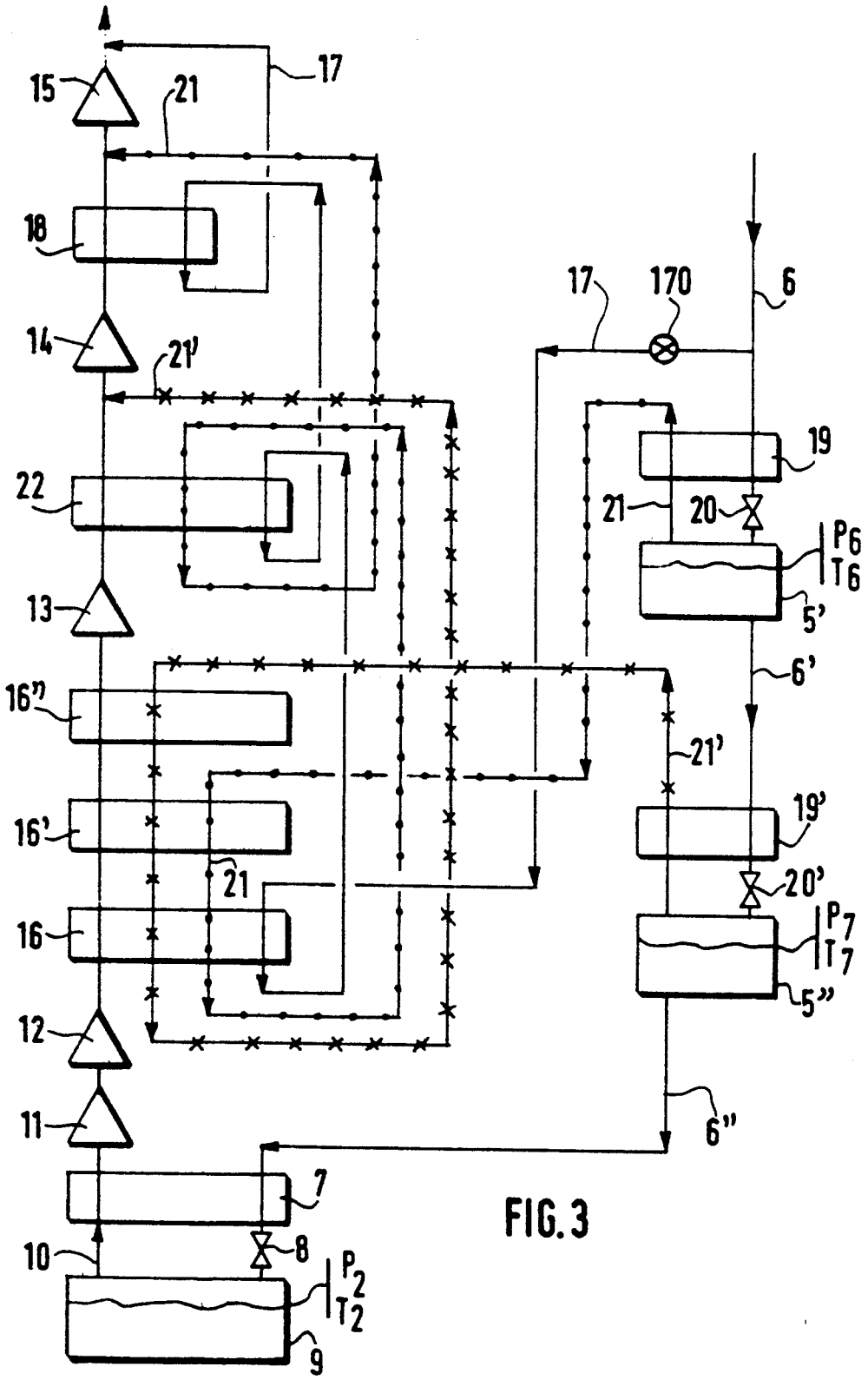
FIG. 3 is a view analogous to the previous ones illustrating a third embodiment of the invention.

The embodiment of FIG. 3 includes a combination of the controllable variant which uses the boiling liquid at substantially atmospheric pressure of FIG. 1, and the non-controllable variant but with increased stability exploiting the boiling liquid at reduced pressure of FIG. 2. FIG. 3 shows the elements of FIGS. 1 and 2 with the same reference numerals as on the latter. In FIG. 3, the first exchanger is decomposed in at least two exchangers 16', through which duct 21 passes, and 16, upstream of exchanger 16', through which ducts 21 and 17 pass. Exchanger 16 is here connected to line 10 downstream of the last compressor 15, the two ducts 17 and 21 additionally passing through a third exchanger 22 advantageously disposed between the third and fourth compressors 13 and 14.

The embodiment of FIG. 3 additionally includes, in order to still reduce the suction temperature of the first stage 11, in line 6', downstream of the first additional container 5', a second additional container 5'' which is associated, upstream, as the first additional container 5, to an exchanger 19', with an intermediate expansion device 20'. The container 5'' thus contains liquid and a gaseous helium at a pressure $P_7$ of about $0.15\times10^5$ Pa and a temperature of about 2.8K. The liquid helium in container 5'' is removed through channel 6'' to be sent to exchanger 7 and container 9 at pressure and temperature $P_2$ and $T_2$. The gaseous helium in container 5'' is sent through a duct 21' towards exchangers 16' and 16, via a third first exchanger 16'', then towards line 10, upstream of the fourth compressor 14.

In this variant, depending on needs, only the circuits utilizing additional containers 5' and 5'' may be used, or simultaneously these circuits and the controllable circuit utilizing the line of liquid helium 17 may be used, which thus gives a good latitude for the operating ranges on the line of compressors 10.

Although the present invention has been described with respect to specific embodiments, it is not limited thereto, but on the contrary, it is capable of modifications and variants which will appear to one skilled in the art. In particular, depending on needs and materials available, it is possible to decrease or increase the number of compression stages and inter-stage exchangers.

We claim:

1. Compression circuit for a lower pressure, low temperature gaseous fluid from a first container containing the fluid in liquid and gaseous phases of a first pressure and a first temperature, comprising: a line connecting the first container to a reheater, at least two compressors mounted in series on said line, said first container being fluidly connected to and fed by a second container containing the fluid in liquid and gaseous phases at a second pressure and a second temperature higher than the first pressure and temperature, said line having between the two compressors, at least one first exchanger which is fluidly connected to said second container, whereby said first exchanger is cooled by means of a fluid from the second container.

2. Circuit according to claim 1, wherein the first exchanger is fluidly connected to and cooled by the liquid phase of the second container.

3. Circuit according to claim 2, which comprises at least three compressors and at least one second exchanger between the two downstream compressors, said second exchanger being fluidly connected to and cooled by the gaseous phase which comes from the first exchanger.

4. Circuit according to claim 2, wherein the second container is the container of a cycle for refrigerating helium containing liquid helium at a pressure of about $1.2\times10^5$ Pa and a temperature of about 4.4K.

5. Circuit according to claim 1, wherein the first exchanger is fluidly connected to and cooled by the gaseous phase of the second container.

6. Circuit according to claim 5, which comprises at least three compressors, said gaseous phase coming from the second container and reheated in the first exchanger being reintroduced upstream of the downstream compressor.

7. Circuit according to claim 5, wherein the second container contains liquid and gaseous helium at a pressure of about $0.5\times10^5$ Pa and a temperature higher than 3K.

8. Circuit according to claim 7, wherein the second container is supplied by a container of a cycle for refrigerating helium containing liquid helium at a pressure of about $1.2\times10^5$ Pa and a temperature of about 4.4K.

9. Circuit according to claim 1, wherein the second container is fluidly connected to and fed by a third container containing the fluid in liquid and gaseous phases.

10. Circuit according to claim 9, wherein the fluid is gaseous phase in the third container is fluidly connected to and cools at least the first exchanger.

11. Circuit according to claim 1, wherein the fluid in the first container is helium at a pressure lower than 20 hPa at a temperature lower than 4.2K.

12. Circuit according to claim 11, wherein the first container is supplied with liquid helium through the second container via an exchanger and an expansion device.

* * * * *